US010312653B2

(12) United States Patent
Ballard et al.

(10) Patent No.: US 10,312,653 B2
(45) Date of Patent: Jun. 4, 2019

(54) HYDRAULIC TOOL

(71) Applicant: Milwaukee Electric Tool Corporation, Brookfield, WI (US)

(72) Inventors: James G. Ballard, Waukesha, WI (US); Joseph H. Ellice, Greenfield, WI (US); Eric Norquist, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 28 days.

(21) Appl. No.: 15/147,707

(22) Filed: May 5, 2016

(65) Prior Publication Data

US 2016/0329674 A1 Nov. 10, 2016

Related U.S. Application Data

(60) Provisional application No. 62/157,914, filed on May 6, 2015.

(51) Int. Cl.
*B25B 27/10* (2006.01)
*H01R 43/042* (2006.01)

(52) U.S. Cl.
CPC ..... *H01R 43/0427* (2013.01); *B25B 27/10* (2013.01)

(58) Field of Classification Search
CPC ..... H01R 43/0427; H01R 43/0428; H01R 43/048; B21D 7/06; B21D 9/08; B25B 27/06; B25B 27/10
See application file for complete search history.

(56) References Cited

U.S. PATENT DOCUMENTS 3,326,029 A * 6/1967 Porter ..... H01R 43/0427 72/362
4,226,110 A 10/1980 Suganuma
4,292,833 A * 10/1981 Lapp ..... H02G 1/00 72/409.01
4,339,942 A 7/1982 Svensson
4,947,672 A 8/1990 Pecora et al.
5,062,290 A 11/1991 Hoover
5,111,681 A 5/1992 Yasui et al.
5,113,679 A 5/1992 Ferraro et al.
5,152,162 A 10/1992 Ferraro et al.
5,195,354 A * 3/1993 Yasui ..... B25B 27/10 29/751
5,337,566 A 8/1994 Lomastro et al.
5,442,992 A 8/1995 Sanner et al.
5,477,680 A 12/1995 Heskey et al.
5,553,478 A 9/1996 Di Troia
5,611,228 A 3/1997 Dummermuth
5,727,417 A * 3/1998 Moffatt ..... B21F 15/06 72/453.03
5,778,755 A 7/1998 Boese
5,979,215 A 11/1999 Lefavour et al.
6,044,681 A 4/2000 Frenken
(Continued)

*Primary Examiner* — Tyrone V Hall, Jr.
(74) *Attorney, Agent, or Firm* — McDonnell Boehnen Hulbert & Berghoff LLP

(57) ABSTRACT

A hydraulic tool. The hydraulic tool includes a tool working end and a tool main section operably coupled to the tool working end. The tool main section comprising a ram assembly, the ram assembly includes a pretensioned return spring. A tool transmission end is operably coupled to the tool main section for hydraulically operating the tool working end.

19 Claims, 10 Drawing Sheets

(56) References Cited

U.S. PATENT DOCUMENTS

| | | | | |
|---|---|---|---|---|
| 6,065,326 | A | 5/2000 | Frenken | |
| 6,244,085 | B1 | 6/2001 | Dummermuth | |
| 6,276,186 | B1 | 8/2001 | Frenken | |
| 6,401,515 | B2 | 6/2002 | Frenken | |
| 6,446,482 | B1 * | 9/2002 | Heskey | B25B 27/10 72/453.02 |
| 6,490,962 | B1 | 12/2002 | Schultz | |
| 6,510,719 | B2 | 1/2003 | Goop | |
| 6,510,723 | B2 | 1/2003 | Amherd | |
| 6,564,510 | B2 | 5/2003 | Lefavour et al. | |
| 6,666,064 | B2 | 12/2003 | LeFavour et al. | |
| 6,668,613 | B2 | 12/2003 | Lefavour et al. | |
| 6,679,340 | B1 | 1/2004 | Tatai | |
| 6,718,870 | B1 | 4/2004 | Frenken | |
| 6,745,611 | B2 | 6/2004 | Lefavour et al. | |
| 6,769,356 | B2 | 8/2004 | Frenken | |
| 6,792,789 | B1 | 9/2004 | Faucher | |
| 6,957,560 | B2 | 10/2005 | Lefavour et al. | |
| 6,986,274 | B2 | 1/2006 | Lefavour et al. | |
| 6,990,888 | B2 | 1/2006 | Harwath et al. | |
| 7,066,003 | B2 | 6/2006 | Lefavour et al. | |
| 7,111,488 | B2 | 9/2006 | Lefavour et al. | |
| 7,124,608 | B2 | 10/2006 | Goop | |
| 7,124,619 | B1 | 10/2006 | Lefavour et al. | |
| 7,134,314 | B1 | 11/2006 | Peterson et al. | |
| 7,165,439 | B2 | 1/2007 | Lefavour et al. | |
| 7,254,982 | B2 | 8/2007 | Frenken | |
| 7,412,868 | B2 | 8/2008 | Frenken | |
| 7,421,877 | B2 | 9/2008 | Frenken | |
| 7,428,812 | B2 | 9/2008 | Montminy et al. | |
| 7,464,578 | B2 | 12/2008 | Ayer et al. | |
| 7,487,654 | B2 | 2/2009 | Lefavour et al. | |
| 7,533,556 | B2 | 5/2009 | Lefavour et al. | |
| 7,634,859 | B2 | 12/2009 | Amherd | |
| 7,640,780 | B2 | 1/2010 | Ruland | |
| 7,665,343 | B2 | 2/2010 | Ballas et al. | |
| 7,762,117 | B2 | 7/2010 | Faucher et al. | |
| 7,778,779 | B2 | 9/2010 | Frenken | |
| 7,788,962 | B2 * | 9/2010 | Chiasson | B25B 27/10 29/751 |
| 7,841,223 | B2 | 11/2010 | Rollins et al. | |
| 7,908,963 | B2 | 3/2011 | Frenken | |
| 7,926,321 | B2 | 4/2011 | Rollins et al. | |
| 8,056,473 | B2 | 11/2011 | Frenken | |
| 8,074,482 | B2 | 12/2011 | College | |
| 8,245,461 | B2 | 8/2012 | Frenken | |
| 8,276,430 | B2 | 10/2012 | Barezzani et al. | |
| 8,316,685 | B2 | 11/2012 | Stucki et al. | |
| 8,656,574 | B2 | 2/2014 | Frenken | |
| 8,672,054 | B2 | 3/2014 | Frenken | |
| 8,839,653 | B2 | 9/2014 | Roman, Jr. et al. | |
| 8,844,436 | B2 | 9/2014 | Frenken | |
| 8,919,176 | B2 * | 12/2014 | Barezzani | B25B 27/10 72/453.05 |
| 9,015,916 | B2 | 4/2015 | Frenken et al. | |
| 9,016,103 | B2 | 4/2015 | Frenken | |
| 9,016,317 | B2 | 4/2015 | Myrhum, Jr. | |
| 9,044,851 | B2 | 6/2015 | Tully | |
| 9,162,353 | B2 | 10/2015 | Ciotti | |
| 9,180,583 | B2 | 11/2015 | Frenken | |
| 2014/0260505 | A1 * | 9/2014 | Bowles | B25F 3/00 72/453.16 |

* cited by examiner

HYDRAULIC TOOL

CROSS REFERENCE RELATED APPLICATION

The present application claims priority to U.S. Provisional patent application Ser. No. 62/157,914 filed on May 6, 2015, and entitled "Hydraulic Tool," which is herein incorporated by reference as if fully set forth in this description.

BACKGROUND

The present disclosure relates to a hydraulic tool. More particularly, the present disclosure relates to a hydraulic crimp and/or cutting tool providing reduced weight and improved weight distribution.

Hydraulic power tools are employed in numerous applications to provide a user with a desired mechanical advantage. One example application is a battery powered hydraulic crimp tool that may be used for crimping various types and sizes of power connectors onto conductors. Typically, in such crimping applications, the battery powered hydraulic tool must be light weight as the tool will often be used repeatedly to perform multiple crimping applications while not fatiguing the tool operator. In addition, such a hydraulic tool should also be portable so that it can be carried by an operator from one work site to the next. Typically, such battery powered hydraulic tools are generally heavy and difficult to handle during crimping operations. One reason for the general weight and cumbersomeness of such a hydraulic tool is that such tools are often the subject to high loads during operation (typically upwards to 6 Tons) and therefore need a suitable tool operating head and main body structure that can sustain such large and repetitive loads.

As such, there is therefore a desire to provide a more light weight hydraulic tool that can be used for high force applications, such as 12 Ton applications. Accordingly there is a desire to provide an improved hydraulically operated tool that has a reduced overall weight and also perhaps reduces the overall length of the tool, making the tool more user friendly to the operator.

SUMMARY

In one embodiment the present disclosure, a hydraulic tool is disclosed. The hydraulic tool comprises a tool working end and a tool main section operably coupled to the tool working end. The tool main section comprising a ram assembly, the ram assembly includes a pretensioned return spring. A tool transmission end is operably coupled to the tool main section for hydraulically operating the tool working end.

The features, functions, and advantages can be achieved independently in various embodiments of the present disclosure or may be combined in yet other embodiments in which further details can be seen with reference to the following description and drawings.

DETAILED DESCRIPTION

Figure 1:
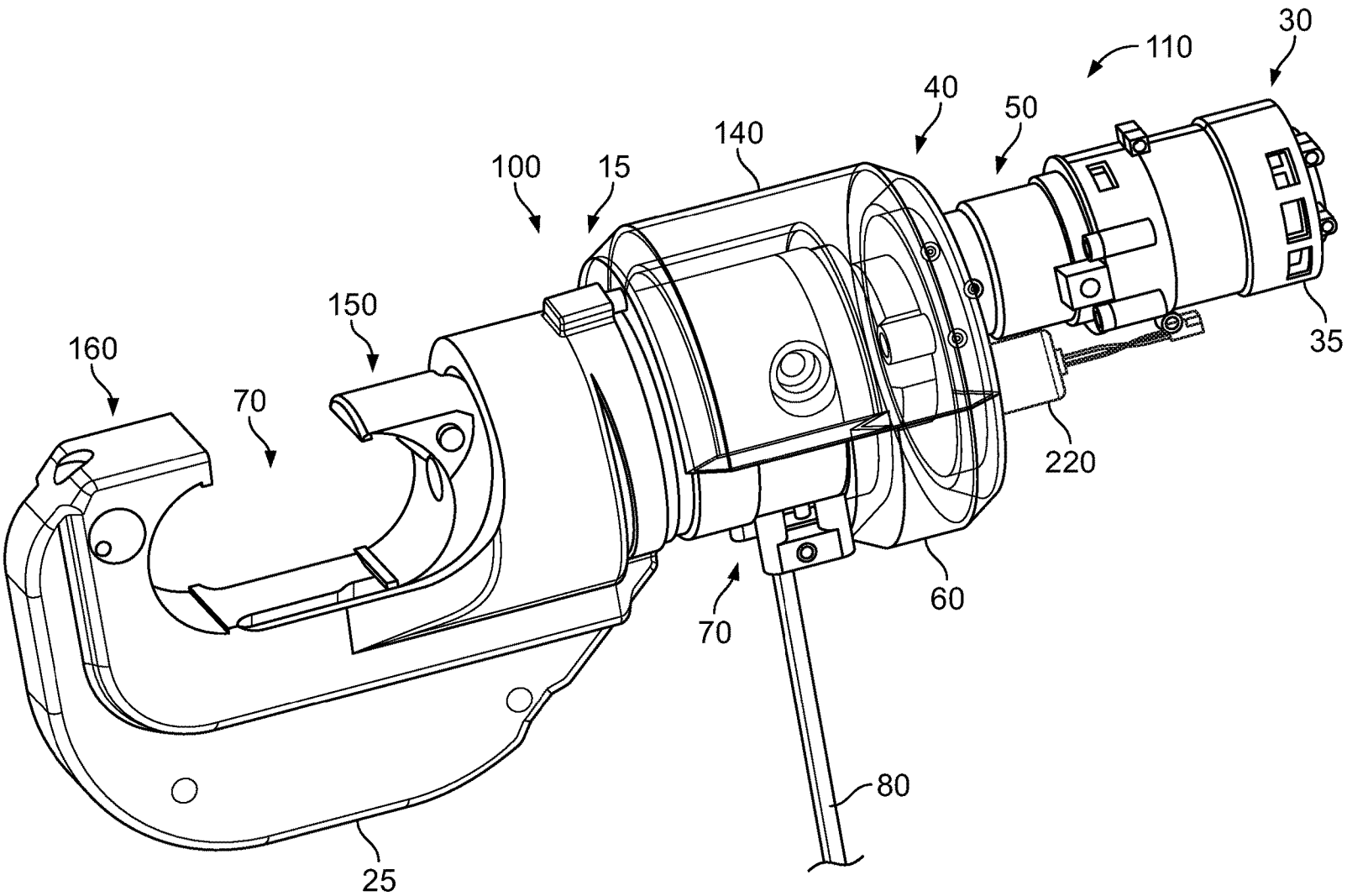
FIG. 1 is a perspective view of an exemplary hydraulic tool.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Figure 2:
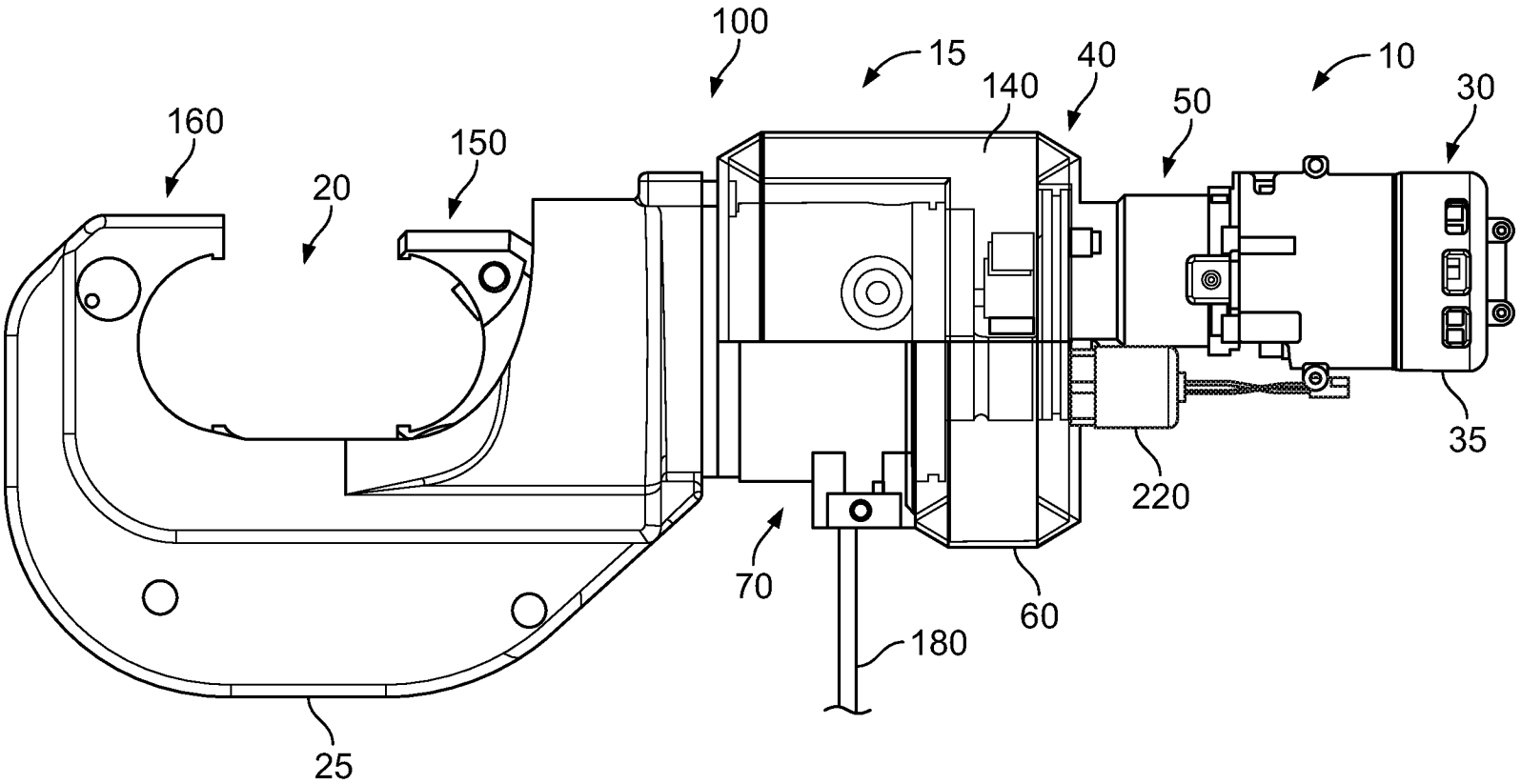
FIG. 2 is another perspective view of the exemplary hydraulic tool illustrated in FIG. 1.

FIG. 1 illustrates a perspective view of a hydraulic tool 10 and FIG. 2 illustrates another perspective view of the hydraulic tool 10 illustrated in FIG. 1. Referring now to both FIGS. 1 and 2, there is shown a side view of a hydraulic tool 10 incorporating features of the present disclosure. Although the hydraulic tool 10 will be described with reference to the exemplary embodiment shown in the drawings, it should be understood that the hydraulic tool and its various components can be embodied in many alternate forms of embodiments. In addition, any suitable size, shape or type of elements or materials could be used.

In this illustrated arrangement, the hydraulic tool 10 comprises a hand-held battery operated hydraulic crimping tool. However, in alternate embodiments, features of the present disclosure could be used in a suitable type of hydraulic tool or pneumatic tool, or tool having a movable ram. The tool 10 generally comprises a tool main section 15, a tool working end 20, and a tool transmission end 30. In this embodiment the tool working end 20 comprises a moveable die head 150 that is separated from a crimper head 160 by a frame 25. For example, in this illustrated embodiment, the crimper head 160 comprises a C-style head. The die head 150 is axially moveable along the frame 25 of the C-style head and is adapted to receive removable crimp dies. However, in alternate embodiments any suitable dies could be provided including cutting dies for example.

The tool main section 15 generally comprises a cylinder 140, a ram assembly 100, a bladder 60, a hydraulic pump 40, a hydraulic fluid passage circuit 70, and a user activated release lever 180. As will be described herein, this hydraulic fluid passage circuit 70 comprises a plurality of fluid passages that provide fluid communication between a fluid reservoir or bladder 60 which provides fluid communication to and from the tool working end 20 by way of the ram assembly 100. As will be explained herein, the hydraulic tool 10 can be provided with a user activated control system including a user actuated human interface devices, such as a user activated release switch, a start switch or trigger, and a release lever 180.

Figure 4:
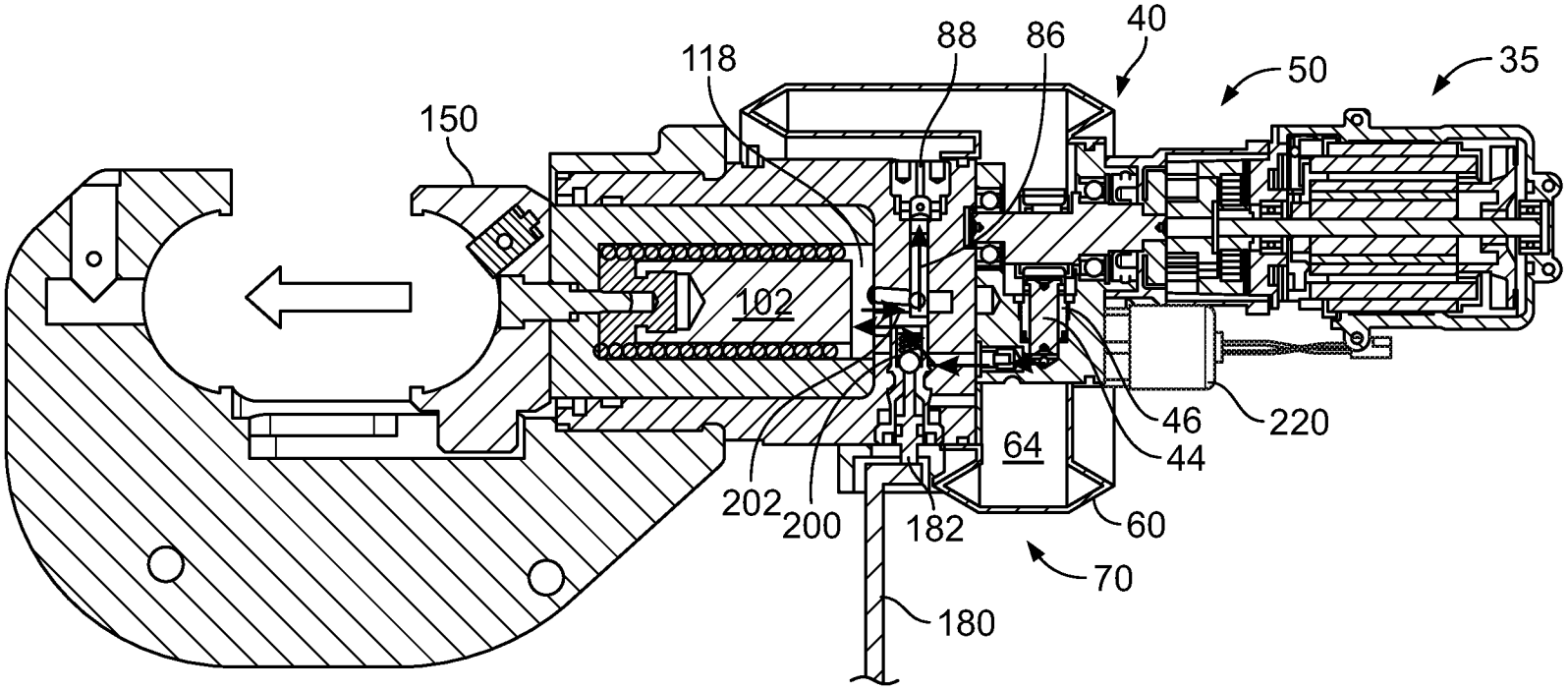
FIG. 4 is a cross-sectional view of the hydraulic tool illustrated in FIG. 1 at the start of a crimp cycle.

Although the presently illustrated hydraulic tool 10 may comprise a battery operated hydraulic tool, in an alternate embodiment, the tool main section 15 could be adapted to be connected to a remote hydraulic fluid supply by hydraulic hoses. In one preferred arrangement, the hydraulic tool 10 is configured as a self contained manually operated hydraulic crimping tool. In one alternative arrangement, the hydraulic tool 10 is configured as a self contained manually operated hydraulic cutting tool. The tool main section 15 may also comprise a pressure transducer 220 (FIG. 4).

Referring now also to FIGS. 1 and 2, the ram assembly 100 is movably connected to the frame 25 in a longitudinal direction, wherein the ram assembly 100 is adapted to be moved relative to the frame 25 by hydraulic fluid 64 contained within the bladder 60 and under control by way of the fluid hydraulic passage circuit 70 as will be described in greater detail herein.

The hydraulic tool 10 further comprises a tool transmission end 30. The tool transmission end 30 of the hydraulic tool 10 comprises an electric motor 35 configured to drive the hydraulic pump 40 by way of a gear reducer 50. An output shaft 38 (FIG. 3) of the motor 35 is connected to the pump 40 by way of a gear reduction or gearbox 50. Any suitable type of gear reduction assembly could be provided. For example, in one preferred arrangement, the gear reducer comprises a 10 to 1 gear reduction.

Figure 3:
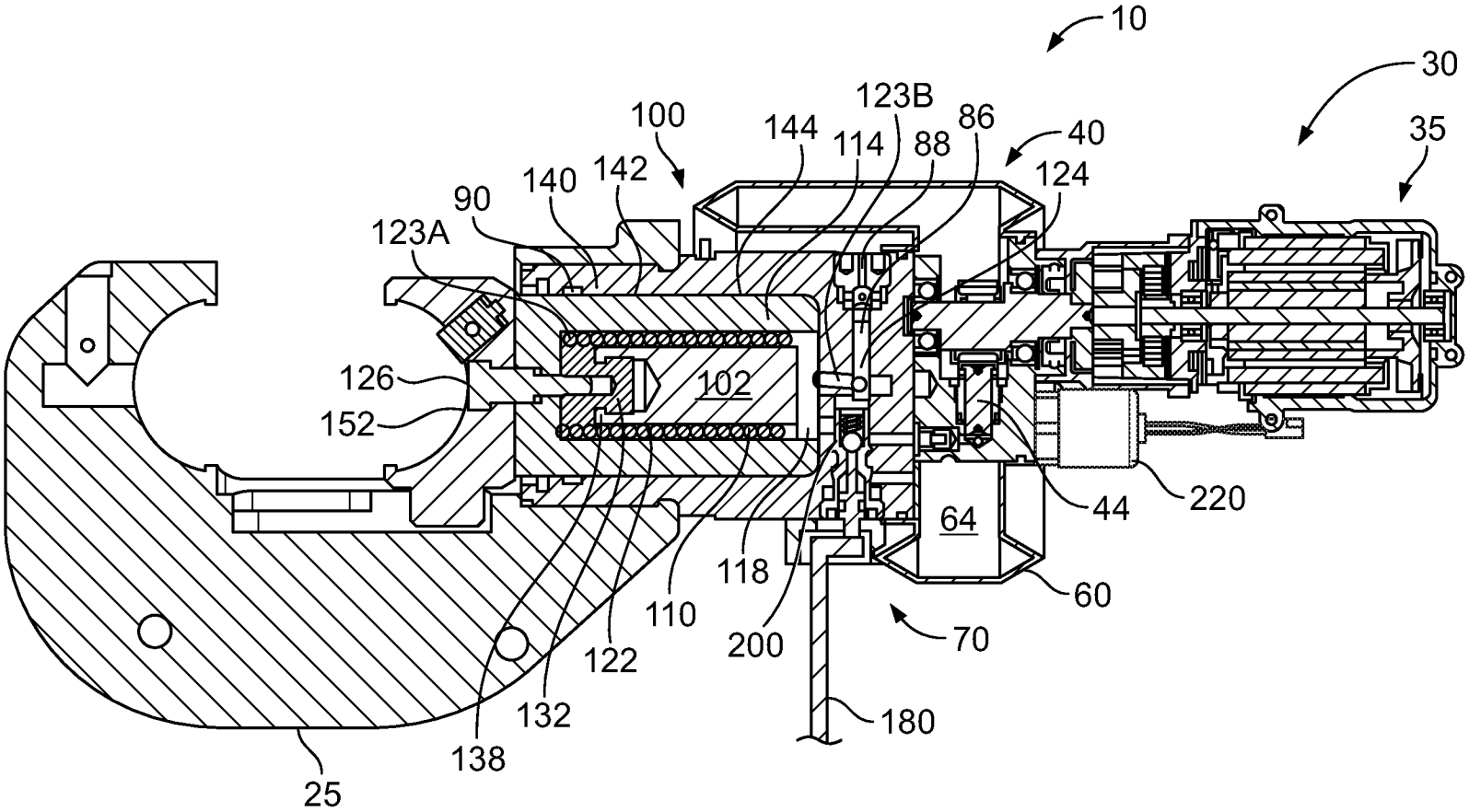
FIG. 3 is cross-sectional view of the hydraulic tool illustrated in FIG. 1.

FIG. 3 is cross-sectional view of the hydraulic tool illustrated in FIG. 1. As illustrated, the main section 15 of the hydraulic tool 10 further comprises a bladder 60 that contains a hydraulic fluid 64. The bladder 60 operates as a reservoir for storing hydraulic fluid 64. Generally, as the electric motor 35 rotates, a pump piston 44 reciprocates up and down. The pump piston 44 provides the hydraulic fluid 64 to a hydraulic fluid passage circuit 70. Specifically, as the pump piston 44 moves upward, hydraulic fluid 64 is withdrawn from the bladder 60. As the pump piston 44 moves down, the withdrawn fluid is pressurized and delivered to the ram assembly 100 by way of the fluid passage circuit 70 as will be described in detail herein.

In this illustrated arrangement, a cylinder 140 is operatively coupled to the pump assembly 40. In one preferred arrangement, the pump assembly 40 comprises a high pressure pump assembly. However, other types of pump assemblies may also be used. The cylinder 140 defines a cylinder cavity 142 and this cylinder cavity 142 is configured to contain the ram assembly 100. A high pressure seal 90 is provided between an outer surface 110 of the ram assembly 100 and an inner surface 144 of the cylinder cavity 142.

In this illustrated arrangement, the cylinder 140 is operatively coupled to the frame 25. For example, the cylinder 140 is threaded to the frame 25. In an alternative arrangement, the cylinder 140 and the frame comprise an integral component. Such an integral cylinder and frame component results in certain advantages. For example, such an integral component allows for the removal of the threads from an area of frame deflection that may occur during a crimp cycle. As such, less material can be used for the integral cylinder and frame component, resulting in a lighter hydraulic tool.

Again referring to FIG. 3, the ram assembly 100 comprises a main ram portion 114. Preferably, this main ram portion 114 defines a main ram chamber 118. This main ram chamber 118 is configured to contain various component parts of the ram assembly 100. In one preferred arrangement, these various component parts include: a return spring 122, a ram spacer 126, a spring retainer screw 132, and a ram piston 102. In one preferred arrangement, the return spring 122 comprises a return spring extension type. That is, in such a return spring extension type arrangement, the return spring 122 comprises a spring that will extend or elongate as the ram assembly 100 extends along the frame 25 of the tool working end 20 during a crimp cycle. The return spring 122 is positioned to extend from a front portion of the main ram chamber 118 to a back portion of the cylinder 140. In addition, and as illustrated in this hydraulic tool arrangement 10, the return spring 122 is configured to surround an outer surface 110 of the ram piston 102.

Specifically, a first end 123A (an end of the return spring 122 near the die head 150) of the return spring 122 may be affixed to the spring return screw 132. A second end 123B of the return spring 122 may be affixed to a portion of the cylinder 140 near the pump assembly 40. In one arrangement, the second end 123B of the return spring 122 may comprise a spring loop 124. In order to affix this spring loop 124 within the cylinder 140, the loop 124 may be passed through a fluid passage 78 and then affixed around a hollow passage pin 86 that is inserted into the spring loop 124. As will be described in greater detail herein, the hollow passage pin 86 provides for fluid communication between the ram assembly chamber 118 and an over pressure device 88.

In one preferred arrangement, when the ram assembly 100 is initially assembled in this manner, the ram spacer 126 may be operatively coupled through a cavity 152 defined by the die head 150 to a front end of the spring return screw 132. In such a configuration, when the ram spacer 126 and hence the spring return screw 132 are threaded into a front threaded end 138 of the ram piston 102, the depth of how far the spring return screw 132 may be threaded into this threaded end 138 of the ram piston 102 can be varied. As such, a variable and predetermined amount of tension can be provided within the return spring 128 while the ram assembly resides in a retracted or home position as illustrated in FIG. 3.

The ram assembly 100 is slidably received within the cylinder cavity 142 defined by the cylinder 140. Importantly, the return spring 122 surrounds the ram piston 116 and resides along an inner surface 120 of the ram assembly chamber 118. Extension of the ram 100 during a user activated crimp disturbs the pre-tensioned state of the return spring 122, thereby causing the return spring 122 to apply a pulling force on the ram assembly 100 that seeks to return the ram 114 to an un-extended position.

Such a ram assembly 100 comprising an internally supported and pre-tensioned return spring 122 provides certain advantages. For example, in certain known ram assembly and return spring configurations, the ram assembly is provided with a compression spring wherein such a compression spring typically comprises a constant height. One disadvantage of such a ram and constant height return spring combination is that excessive wear against the internal cavity of the cylinder can be created by the constant height return spring as the ram assembly is moved back and forth during crimp procedures. Such excess wear is prevented by the presently disclosed ram assembly internal return spring configuration.

Another advantage of such a ram assembly and extension spring arrangement is that it reduces the length of the cylinder and ram based on the spring type. For example, a compression spring can only be compressed to its solid height. This distance becomes significant when used as a return spring in a hand held hydraulic tool. It is the solid height dimension that can be subtracted from the length of the cylinder and ram assembly when an extension spring is used.

Another advantage of the presently disclosed ram assembly 100 is that such a ram and spring configuration allows for a certain amount of pre-tension to be provided on the spring. One advantage of such a pre-tensioned ram is that it enhances the return rate of the ram assembly back to the retracted or home position. In addition, the presently disclosed ram assembly 100 also provides the manufacturer of the hydraulic tool 10 to select or design a specific or predetermined amount of tension within the ram assembly return spring.

The tool main section 15 of the hydraulic tool 10 further includes a release lever 180. As illustrated, the release lever 180 is operably coupled to a release valve 200 provided within the hydraulic fluid passage circuit 70. During a crimping action, if a user were to activate the release lever 180, the release lever 180 would open the release valve 200 so as to release fluid 64 in the main ram chamber 118 back to the bladder 60, thus relieving pressure in the main ram chamber 118.

Figure 5:
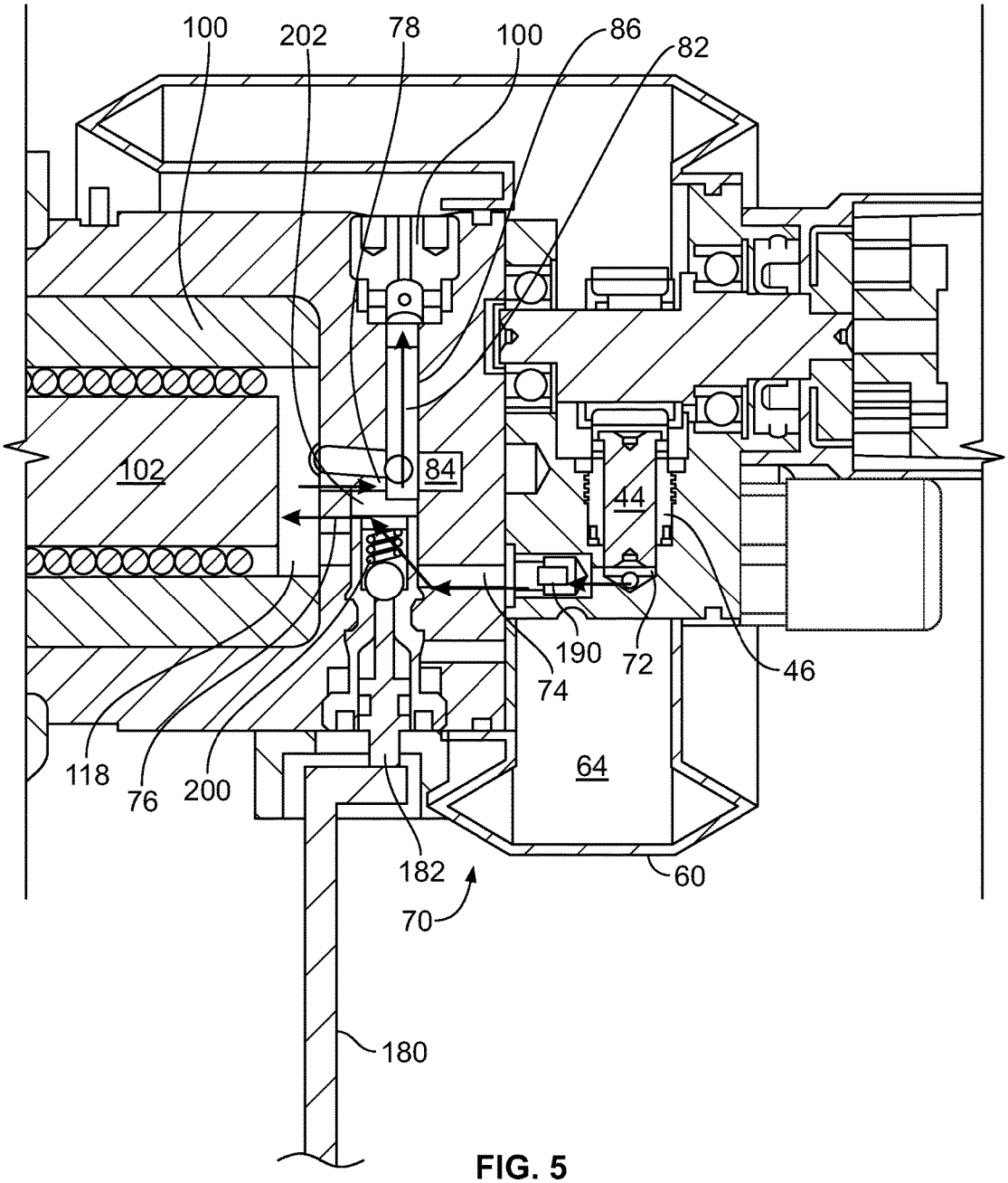
FIG. 5 is a close up, cross-sectional view of the hyrdaulic fluid passage circuit of the hyrdaulic tool illustrated in FIG. 4.
Figure 9:
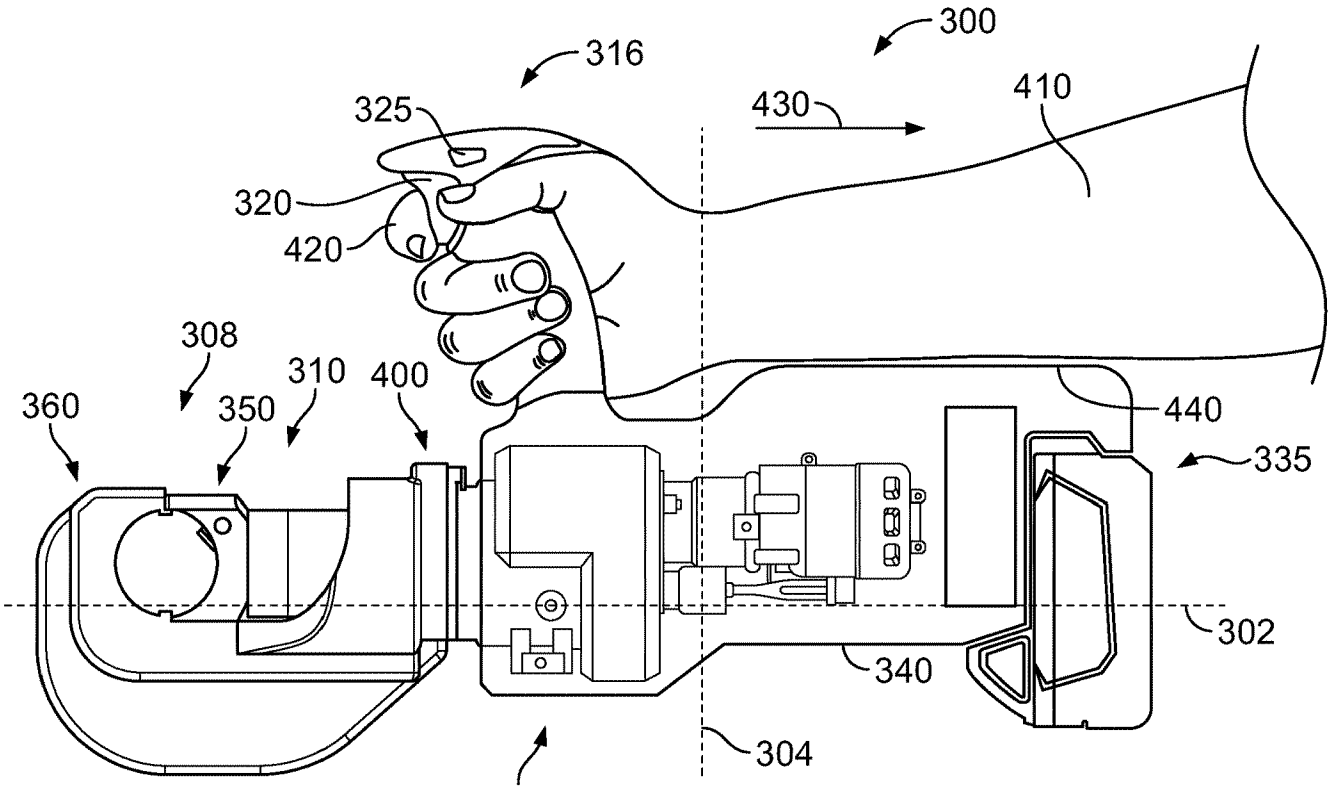
FIG. 9 illustrates an exemplary hydraulic tool housing arrangement for use with a hydraulic tool, such as the hydraulic tool illustrated in FIG. 1.

FIG. 4 is a cross-sectional view of the hydraulic tool illustrated in FIG. 1 at the start of a crimp cycle and FIG. 5 is a close up, cross-sectional view of the hydraulic fluid passage circuit 70 of the hyrdaulic tool illustrated in FIG. 4. In order to initiate a crimping cycle, a user activates a switch, such as a start trigger switch (FIG. 9). This starts the motor 35 and the gear reducer 50 begins to activate the pump assembly 40. Activation of the pump assembly 40 begins to activate the pump piston 44.

Figure 6:
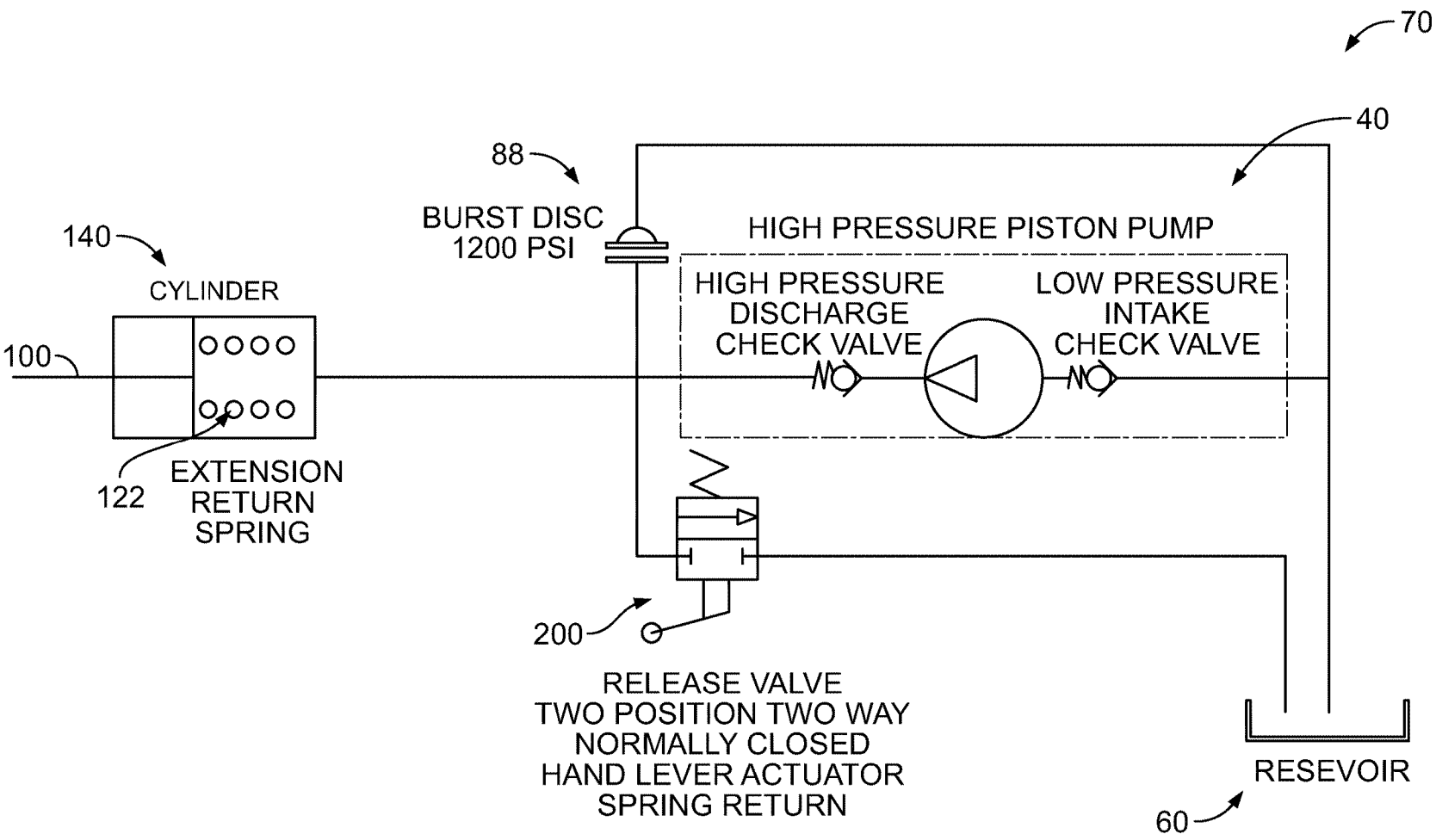
FIG. 6 is a schematic representation of the hydraulic fluid passage circuit illustrated in FIG. 5.

FIG. 6 is diagrammic representation of the hydraulic circuit illustrated in FIGS. 4 and 5. Referring now to FIGS. 4, 5, and 6, when the pump piston 44 moves upward, hydraulic fluid 64 is withdrawn from the bladder 60 through the intake check valve into a pumping chamber 46 of the pump assembly 40. When the pump piston 44 moves downward, the hydraulic fluid 64 is pressurized and is forced to begin to flow into the hydraulic fluid passage circuit 70. Specifically, the hydraulic fluid 64 begins to flow by way of a first fluid passage 72 through a high pressure check valve 190 and then into a second fluid passage 74. At this second fluid passage 74, the hydraulic fluid 64 then passes through a release valve 200, and into a third fluid passage 76. Fluid 64 then flows from this high pressure check valve 190 into a release valve chamber 202 within the release valve 200. Fluid 64 then flows towards the ram assembly chamber 118 by way of the third fluid passage 76. As noted in FIGS. 4 and 5, the release lever 180 is operatively coupled to the release valve 200 by way of a release pin 182.

Flow of pressurized fluid 64 into the ram assembly chamber 118 applies a force on the ram assembly 100, thereby also extending the return spring 122 and therefore increasing the mechanical energy stored within the return spring 122 as the ram assembly is forced to extend towards the crimper head 150 while also extending or stretching the return spring 122. Applying this force on the ram piston 102 causes the ram assembly 100, and therefore the die head 150, to extend (i.e., move left in FIG. 4). A pressure transducer 220 monitors fluid pressure level in the ram assembly chamber 118.

As mentioned above, high pressure fluid applies a force on the ram assembly 100 and causes the ram 114 and the die head 150 to extend. This force depends on a resistance that the die head 150 experiences. That is, if an object existed between the die head 150 and the crimper head 160, the object would resist extension of the die head 150. For example, if the hydraulic tool 10 comprised a crimping hydraulic tool, with a connector between the die head and the crimper head, the connector will be compressed or crimped by the movement of the ram assembly 100 against the crimper head 160.

Figure 7:
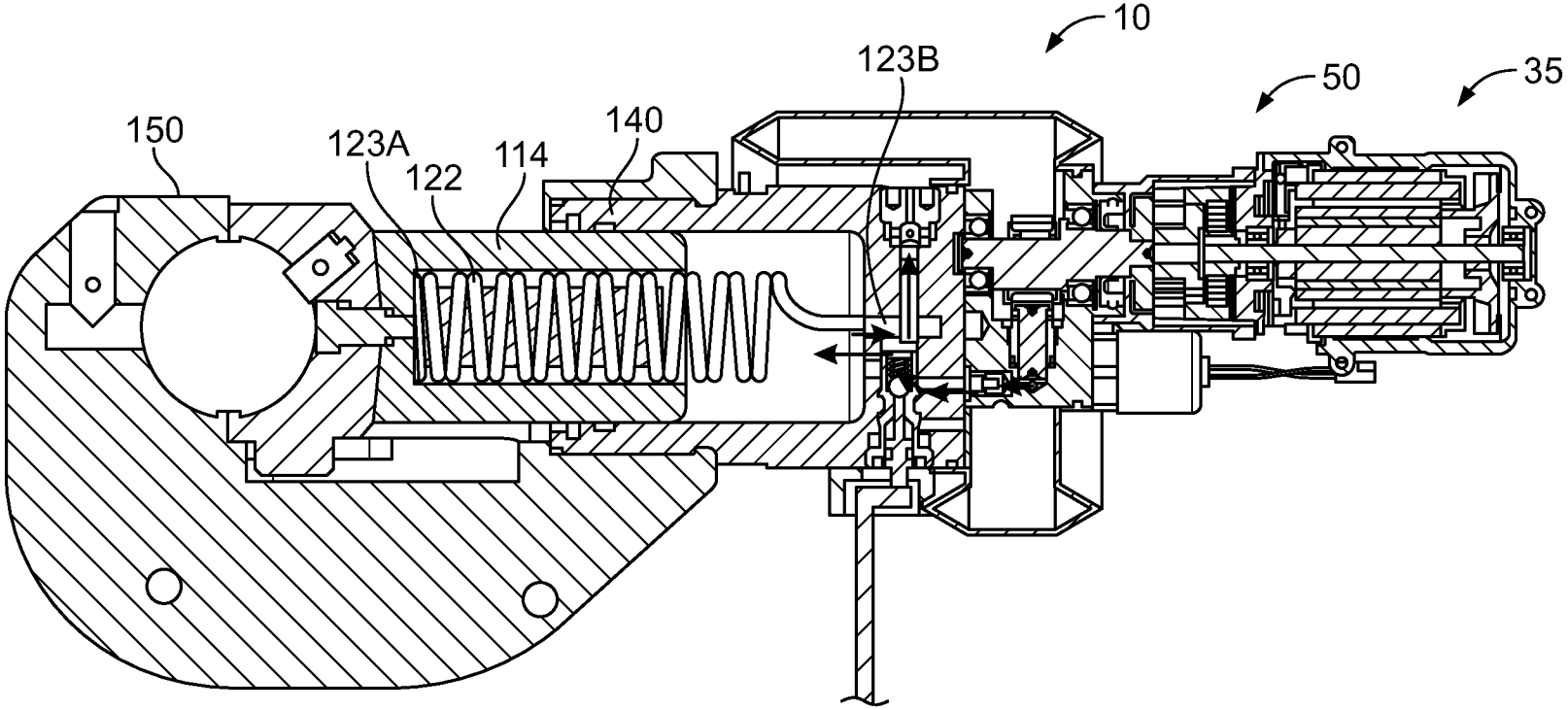
FIG. 7 is a cross-sectional view of the hydraulic tool illustrated in FIG. 1 at the end of a crimp cycle.

Such resistance causes the die head 150 to apply a higher force to extend. Such higher force requires a higher fluid pressure in the ram assembly chamber 118. The pressure transducer 220 monitors pressure in the ram assembly chamber 118, and if the fluid pressure in this chamber 118 exceeds a particular threshold pressure, a controller of the hydraulic tool 10 will cause the electric motor 35 to stop. FIG. 7 illustrates the die head 150 in a fully extended position, in accordance with an example implementation.

Returning to FIGS. 4, 5, and 6, the hydraulic fluid passage circuit 70 further comprises a fourth fluid passage 78 that is in fluid communication with the ram assembly chamber 118 and the release valve chamber 202. In addition, a fifth fluid passage 82 is also in fluid communication with the release valve chamber 202 and with an over pressure device 88, such as a burst cap. Preferably, this fifth fluid passage 82 comprises a hollow passage pin 86. The over pressure device 88 is configured to control or limit the pressure in the hydraulic circuit 70. That is, if the pressure at junction point 84 exceeds a threshold pressure (e.g., if the pressure transducer fails to shut off the motor at the predetermined high pressure stop), the over pressure device 88 will burst and shut down the motor 35.

The hydraulic fluid passage circuit 70 may further include an autocomplete feature. For example, such an autocomplete feature can be configured to lock on the hydraulic tool 10 once the hydraulic fluid passage circuit 70 achieves a predetermined system pressure. For example, in one autocomplete feature arrangement, the user of the hydraulic tool would maintain control of the hydraulic tool from a pressure of approximately 0 pounds per square inch (psi) to a target autocomplete pressure, for example, of 4,000 psi. At this targeted autocomplete pressure of 4,000 psi, the autocomplete feature would turn on and the hydraulic tool would automatically complete the crimping action (or cutting action). One advantage of implementing such an autocomplete feature is that such a feature can help to avoid a situation of the motor 35 potentially stalling during certain operating procedures. For example, such an autocomplete feature will help to prevent a situation where the motor 35 attempts a re-start after the hydraulic fluid passage circuit 70 resides in a high pressure situation. Where such an automatic complete arrangement is utilized in such a hydraulic fluid passage circuit 70, if the pressure at junction point 84 (FIG. 5) exceeds a threshold pressure (e.g., if the pressure transducer 220 fails to shut off the motor 35 at the predetermined high pressure stop), the over pressure device 88 will burst.

Figure 8:
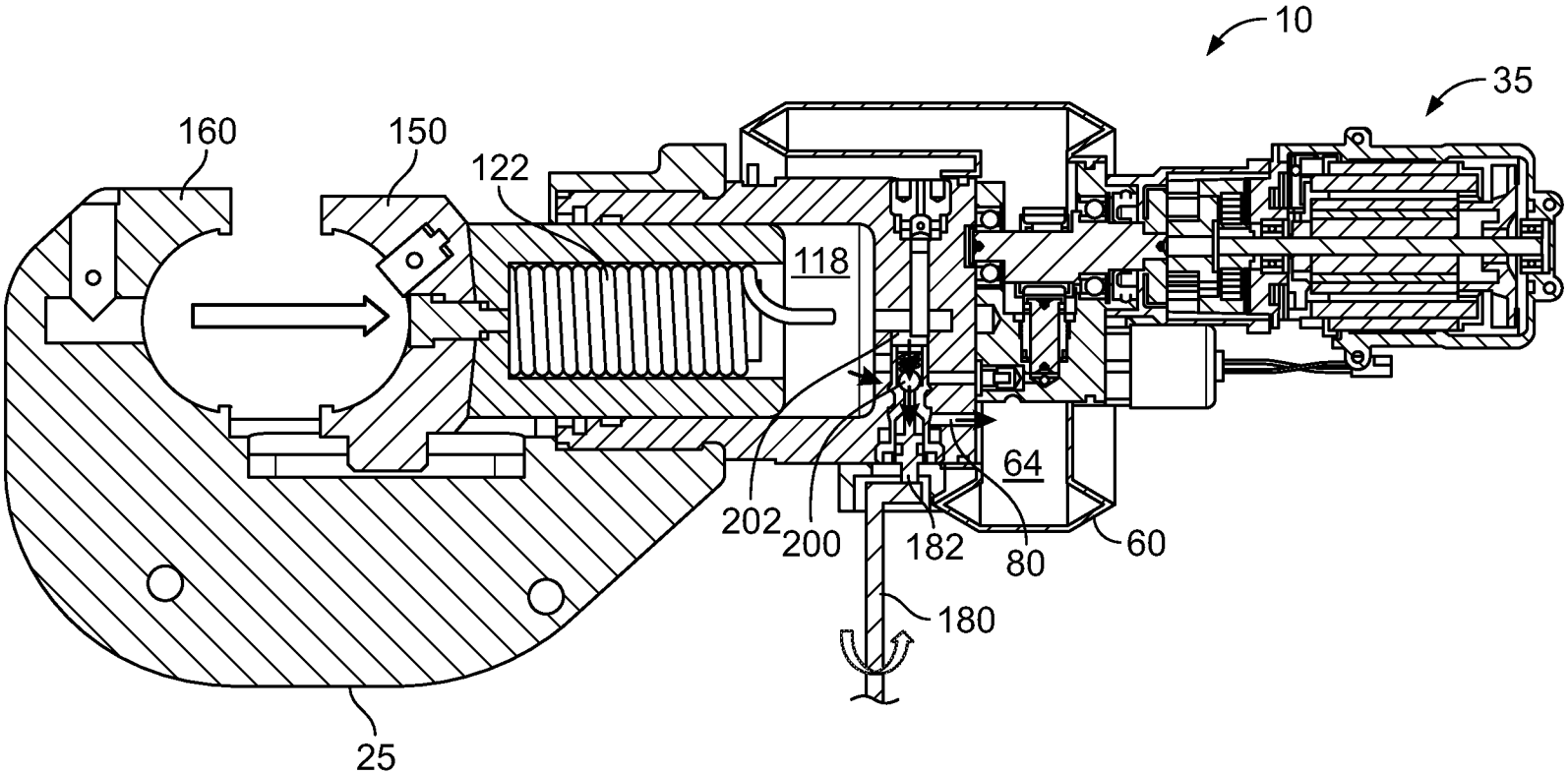
FIG. 8 is a cross-sectional view of the hydraulic tool illustrated in FIG. 1 during a ram return.

FIG. 8 is a cross-sectional view of the hydraulic tool illustrated in FIG. 1 during a ram assembly return. Specifically, FIG. 8 illustrates a return cycle of the hydraulic tool 10 illustrated in FIG. 1 and in accordance with an example implementation. Once the electric motor 35 stops, an operator of the hydraulic tool 10 may be required to actuate the release lever 180. Actuating the release lever 180 actuates the release valve 200. Referring now to FIGS. 5 and 8, in this illustrated arrangement, rotation of the release lever 180 moves the release lever pin 182 and opens the release valve 200. This allows the hydraulic fluid 64 to flow from the ram assembly chamber 118 through the third passage 66 and back into the release valve chamber 202. From the release valve chamber 202, the hydraulic fluid flows back to the reservoir or bladder 60 by way of a sixth passage 80. Further, as mentioned above, the increased amount of stored mechanical energy in the return spring 122 applies a pulling force on the ram assembly 100 that seeks to return the ram assembly 100 back to its original or home/non-retracted position. Due to the fluid release through the release valve 200 and the pulling force of the tensioned return spring 122, the ram assembly 100 retracts (i.e., moves to the right in FIG. 8) seeking to return to an un-extended position.

In one preferred arrangement, the operator of the hydraulic tool can control a position of the ram assembly 100 during the return cycle based on when the release lever 180 is deactivated. Deactivating the release lever 180 prevents the hydraulic fluid 64 from passing through the release valve chamber 202, and therefore stops the ram assembly 100 from moving towards its home position as illustrated in FIG. 2. Specifically, rotation of the release lever activates a release pin 182, allowing the return of the pressurized fluid back to the fluid reservoir 60.

Figure 10:
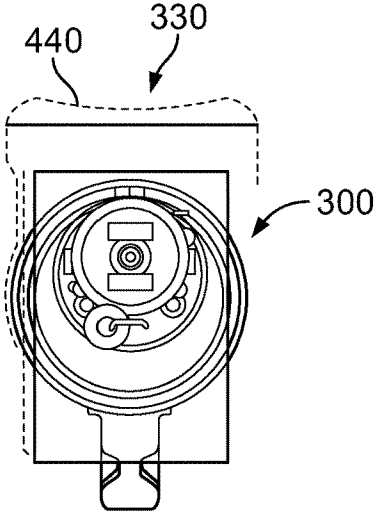
FIG. 10 illustrates a side view of the exemplary hydraulic tool housing arrangement illustrated in FIG. 9.

In order to aid the operator of the hydraulic tool and to provide guidance during this ram retraction step, an outer surface of the ram may be provided with a plurality of markings or indicia. Such markings or indicia may be representative of the ram assembly location and connector size and material representations. For example, the outer surface of the ram may have markings such as 1/0 Cu, 1/0Al and so on to indicate a work space size between the die head 150 and crimper head 160 for a particular connector so as to indicate to the user of the device where what type of ram retraction is required in order for a desired location FIG. 9 illustrates an exemplary hydraulic tool housing arrangement 300 for use with an hydraulic tool, such as the hydraulic tool 10 illustrated in FIG. 1. FIG. 10 illustrates a side view of the tool 300 illustrated in FIG. 9. In particular, FIGS. 9 and 10 depict a tool 300 that is operable to crimp an electrical connector and that has an advantageous arrangement of the tool handle with respect to the tool working end.

Referring to FIG. 9, similar to the hydraulic tool 10 illustrated in FIG. 1, hydraulic tool 300 includes a tool working end 308 disposed at a distal end 310 of the tool. This working end 308 includes a die head 350 and crimper head 360 as herein described. As previously described, the crimper head 360 is movable by way of a ram assembly 400 between a crimping or extracted position (as illustrated) and a home position as herein described. The die head 350 and ram assembly 400 may operate in the same or similar fashion as the die head and ram assembly as described with respect to the hydraulic tool 10 described herein.

The tool 300 further includes a tool main section 314 connected to the working end 308 and also connected to a tool transmission end 335. The tool main section 314 may house tool components, such as internal tool components contained within the tool main section 15 described herein and used for facilitating the hydraulic operation of the ram assembly 100 and the hydraulic fluid passage circuit 70. In one preferred arrangement, the main body includes the hydraulic tool 10 illustrated and described herein.

Further, the main section 314 includes a tool outer housing 340. The main section 314 also includes a handle 316 that is disposed at a distal end 342 of the tool outer housing 340 and along a vertical axis 306 of the tool. As depicted, the handle 316 is configured such that a user 410 can grip the handle 316 in an orientation that is substantially parallel to the vertical axis 304 of the hydraulic tool 300. The tool 300 further includes a trigger 320 disposed on the handle 316, and the trigger 320 is configured to be activated by trigger movement along the horizontal axis 302 of the tool 300. The user may activate the trigger 320 in order to initiate and/or control operation of the working end 308 of the tool 300. In an example, the trigger movement along the horizontal axis 302 comprises movement in a proximal direction along the horizontal axis. For instance, a user may activate the trigger 320 by pulling the user's trigger finger 320 proximally in the horizontal direction along the horizontal axis 302 of the tool 300 as shown by arrow 430. In addition, the handle may also comprise a slide mechanism 325. Such a slide mechanism 325 may comprise a manual slide mechanism. Such a slide mechanism 325 could be used to prevent a false operating start of the hydraulic tool 300. Other example trigger and/or slide mechanism arrangements are possible as well.

The tool 300 further forms a top surface 330. Specifically, the housing 340 forms a top surface 330. For example, FIG. 10 illustrates a side view of the top surface 330 of the tool 300. In an example embodiment, tool 300 may be operated by a single hand of user as illustrated in FIG. 9. In this exemplary embodiment, the top surface 330 of the tool housing 340 comprises a curved arm support 440. The curved arm support 440 provides to add extra support of the tool on a user's arm 410 while the user grasps the tool handle 316 as illustrated in FIG. 9. In this illustrated arrangement, the curved arm support 440 comprises a curved surface to generally conform to a user's forearm 410.

Beneficially, a tool in accordance with the present disclosure offers example advantages over existing hydraulic tools. By being configured to be operated by a single hand of the user, the user may use his or her free hand in order to position and/or stabilize a connector and or wire during a crimping process. In addition, through the unique disclosed orientation of the handle, the tool 300 offers a user the ability to conveniently operate the tool in a plurality of orientations and in compact spaces. In addition, placement of the handle on the hydraulic tool reduces operator fatigue.

Figure 11:
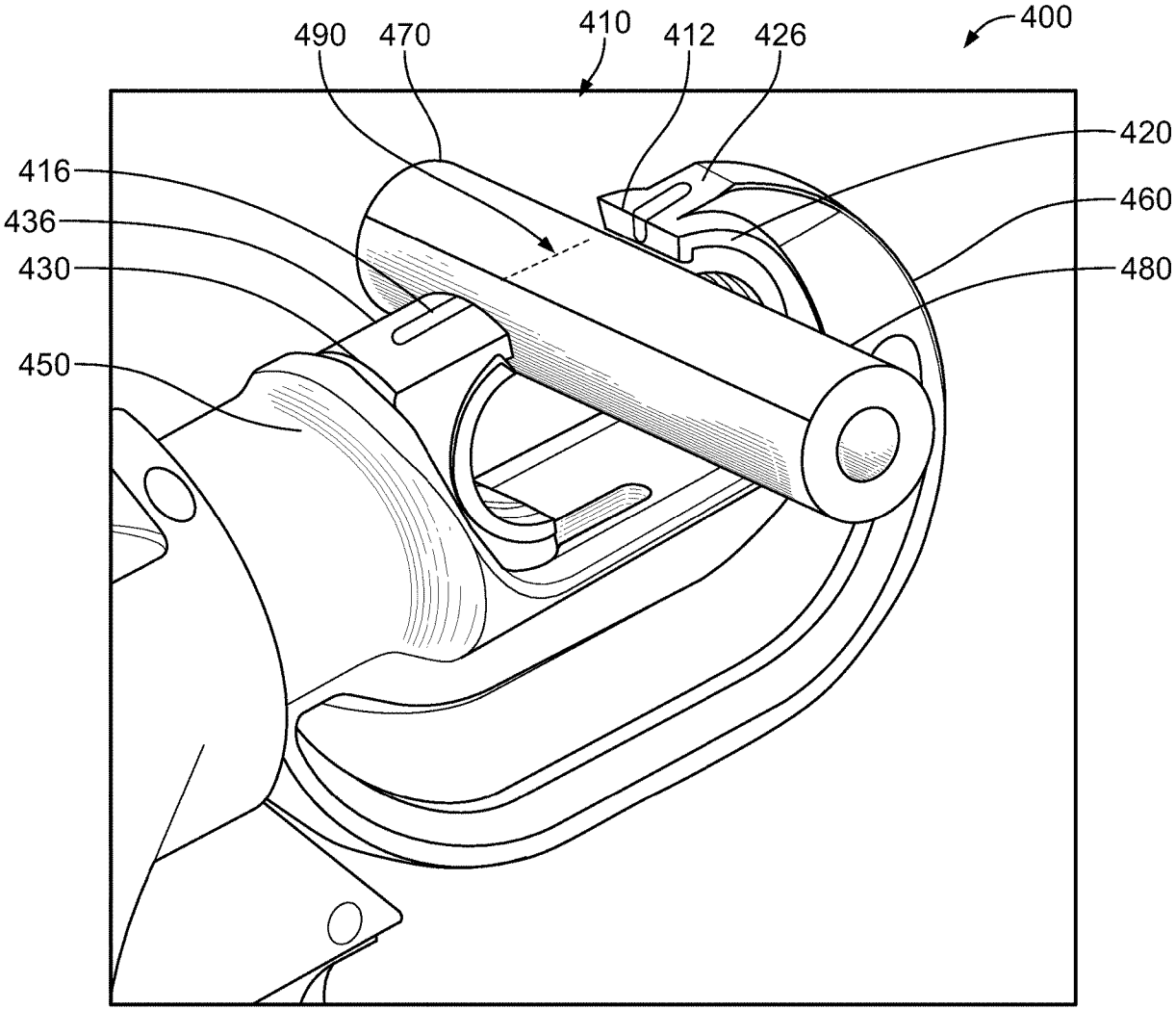
FIG. 11 illustrates an exemplary crimp alignment indicator for use with a hydraulic tool, such as the hydraulic tool illustrated in FIG. 1.

FIG. 11 illustrates an exemplary hydraulic tool arrangement 400 for use with a hydraulic tool, such as the hydraulic tool 10 illustrated in FIG. 1 or the hydraulic tool 300 illustrated in FIG. 9. Such a hydraulic too may comprise a hydraulic crimping tool or alternatively a hydraulic cutting too.

As illustrated, the hydraulic tool 400 comprises a first conductor crimping die 420 and a second conductor crimping die 430. For example, the first crimping die 420 is operably connected to a crimper die head 460, such as the crimping die head 160 illustrated in FIG. 1. Similarly, the second crimping die 430 is operably connected to a moveable die head 450, such as the moveable die head 150 illustrated in FIG. 1. As such, the second crimping die 430 is operably connected to a ram assembly, such as the ram assembly 100 illustrated and described herein.

Preferably, the first and second crimping dies 420, 430 are adapted to be removably mounted to the moveable die head 450 and the crimping die head 460, respectively. The illustrated hydraulic tool 400 further comprises a crimp alignment indicator 410. In this illustrated arrangement, the crimp alignment indicator 410 comprises a first alignment feature 412 and a second alignment feature 416. For example, the first alignment feature 412 is provided along a top surface 426 of the first crimp die 420 and the second alignment feature 416 is provided along a top surface 436 of the second crimp die 430. Preferably, the first alignment feature 412 comprises certain indicia (e.g., a line) that, in one arrangement, is laser etched on the surface 426 of the first crimp die 420. Similarly, the second alignment feature 416 may comprise a similarly etched line.

An electrical connector 470 is also illustrated in FIG. 11. Such a connector 470 may comprise one or more indicia 490 (e.g., line or lines) that indicate a targeted crimping location of the connector 470. Where a connector 470 requires more than one crimp, the connector 470 may comprise one or more indicia indicating one or more crimp target locations 490. With the presently disclosed crimp alignment indicator 410, the first and second alignment features 412, 416 may be aligned with the indicia 490 on the connector 470 during a crimping action. As such, the alignment features 412, 416 on both dies 420, 430 allow a user to see where the connector 470 will be crimped and line up the first and second alignment features 412, 416 with the indicia 490 provided on the connector 470.

Such crimping alignment locator 410 results in certain advantages. For example, the alignment locator 410 provides more accurate crimps of electrical connectors in electrical connector crimping tools. Such a system also reduces potential risk of injury to an hydraulic tool operator by allowing the operator to more accurately identify where crimping will occur on an electrical connector being crimped.

Exemplary embodiments have been described above. Those skilled in the art will understand, however, that changes and modifications may be made to these embodiments without departing from the true scope and spirit of the invention. The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

We claim:

1. A hydraulic tool comprising:

a tool working end;

a tool main section operably coupled to the tool working end, the tool main section comprising a ram assembly, the ram assembly comprising a variable, pretensioned return spring surrounding an outer surface of a ram piston disposed in a main ram chamber, wherein the pretensioned return spring comprises a spring loop coupled to a pin disposed in a fluid passage, wherein the pin is a hollow passage pin having a hollow passage that fluidly couples the main ram chamber to the fluid passage; and a tool transmission end operably coupled to the tool main section for hydraulically driving the tool working end.

2. The hydraulic tool of claim 1, wherein the ram assembly further comprises:

a main ram portion, wherein the main ram portion defines the main ram chamber.

3. The hydraulic tool of claim 2, wherein the ram piston is positioned within the main ram chamber defined by the main ram portion, the ram piston operably coupled to the main ram portion.

4. The hydraulic tool of claim 3, wherein a first end of the pretensioned return spring is affixed to the ram main portion by way of a spring return screw.

5. The hydraulic tool of claim 4, wherein the spring return screw is threaded to a front threaded end of the ram piston such that a depth that the spring return screw may be threaded into this threaded end of the ram piston is variable.

6. The hydraulic tool of claim 4, further comprising a ram spacer operatively coupled to a first end of the spring return screw.

7. The hydraulic tool of claim 6, wherein the ram spacer is operatively coupled through a cavity defined by a die head of the hydraulic tool.

8. The hydraulic tool of claim 3, wherein a second end of the pretensioned return spring is affixed to a portion of a cylinder, and wherein the cylinder defines a cylinder cavity that is configured to contain the ram assembly.

9. The hydraulic tool of claim 8, wherein the second end of the pretensioned return spring comprises the spring loop, wherein the spring loop passes through the fluid passage.

10. The hydraulic tool of claim 9, further comprising:

an over pressure device fluidly coupled to the fluid passage, wherein the hollow passage pin provides for fluid communication between the main ram chamber and the over pressure device.

11. The hydraulic tool of claim 10, wherein the over pressure device comprises a burst cap.

12. The hydraulic tool of claim 1, wherein the hydraulic tool comprises a hydraulic crimping tool.

13. The hydraulic tool of claim 1, wherein the ram assembly is adapted to be moved relative to a frame of the tool working end by hydraulic fluid that is contained within a bladder and that is under control of a fluid passage circuit.

14. The hydraulic tool of claim 13, further comprising:

a hydraulic pump;

a gear reducer; and an electric motor configured to drive the hydraulic pump by way of the gear reducer, and wherein as the electric motor rotates, a pump piston reciprocates thereby providing the hydraulic fluid to the fluid passage circuit, and the hydraulic fluid is withdrawn from the bladder and delivered to the ram assembly, thereby moving the ram assembly towards the tool working end.

15. The hydraulic tool of claim 13, further comprising:

a release lever, wherein deactivating the release lever allows for control of a position of the ram assembly during a return cycle based on when the release lever is deactivated.

16. The hydraulic tool of claim 15, wherein deactivating the release lever prevents hydraulic fluid from passing through a release valve chamber and therefore stops the ram assembly from moving towards a home position.

17. The hydraulic tool of claim 1, further comprising:

an outer housing; and a tool handle disposed near a distal end of the outer housing and along a vertical axis of the hydraulic tool, wherein the tool handle is configured to be gripped in an orientation that is substantially parallel to the vertical axis of the hydraulic tool.

18. The hydraulic tool of claim 17, further comprising:

a trigger disposed on the tool handle, wherein the trigger is configured to be activated by a trigger movement along a horizontal axis of the hydraulic tool.

19. The hydraulic tool of claim 17, wherein the outer housing forms a top surface, and wherein the top surface comprises a curved arm support that supports an arm of a user of the hydraulic tool when the user grasps the tool handle.

* * * * *